US006773207B2

(12) United States Patent
Mathis

(10) Patent No.: US 6,773,207 B2
(45) Date of Patent: Aug. 10, 2004

(54) METHOD OF LOWERING A FLOATING BODY OF A FLOATING FOUNDATION

(75) Inventor: Hugo Mathis, Bregenz (AT)

(73) Assignee: Rund-Stahl-Bau Gesellschaft m.b.H, Fussach (AT)

( * ) Notice: Subject to any disclaimer, the term of this patent is extended or adjusted under 35 U.S.C. 154(b) by 0 days.

(21) Appl. No.: 10/365,792

(22) Filed: Feb. 12, 2003

(65) Prior Publication Data

US 2003/0152429 A1 Aug. 14, 2003

(30) Foreign Application Priority Data

Feb. 14, 2002 (AT) ..... 231/2002
May 31, 2002 (AT) ..... 832/2002

(51) Int. Cl.[7] ..... B63B 35/44
(52) U.S. Cl. ..... 405/224; 405/196
(58) Field of Search ..... 405/195.1, 196, 405/200, 205, 207, 224, 227

(56) References Cited

U.S. PATENT DOCUMENTS 3,086,368 A * 4/1963 Popper ..... 405/224
4,473,323 A * 9/1984 Gregory ..... 405/224.4
4,604,001 A * 8/1986 Wetmore ..... 405/200
4,657,439 A * 4/1987 Petersen ..... 405/224
5,964,550 A 10/1999 Blandford et al. ..... 405/224
6,022,174 A 2/2000 Husvik et al. ..... 405/223.1

FOREIGN PATENT DOCUMENTS

EP 1288122 3/2003
JP 6255573 9/1994

* cited by examiner

*Primary Examiner*—Robert E. Pezzuto
*Assistant Examiner*—Tara L. Mayo
(74) *Attorney, Agent, or Firm*—Sidley Austin Brown & Wood, LLP

(57) ABSTRACT

A method of lowering a floating body of a floating foundation and carrying a structure projecting above the water surface to an end position located beneath the water level, includes threading, through each of the upwardly projecting tubes, which are secured to the floating body above-through-openings formed in the floating body, a cable or a rod and connecting the cable or rod to a set-in-ground anchor, lowering the floating body, with the uptake devices provided at the free ends of the tubes, to the end position of the floating body beneath the water surface against buoyancy of the floating body, and fixidly securing the cables or rods, in the end position of the floating body, to the floating body and cutting off sections of the cables and rods above fixation points of the cables and rods with the floating body and removing the tubes.

16 Claims, 5 Drawing Sheets

4
2
28
1
9
9
27
3
10
11
12
12

8
5
7
6
7
5
3
6

Fig. 3
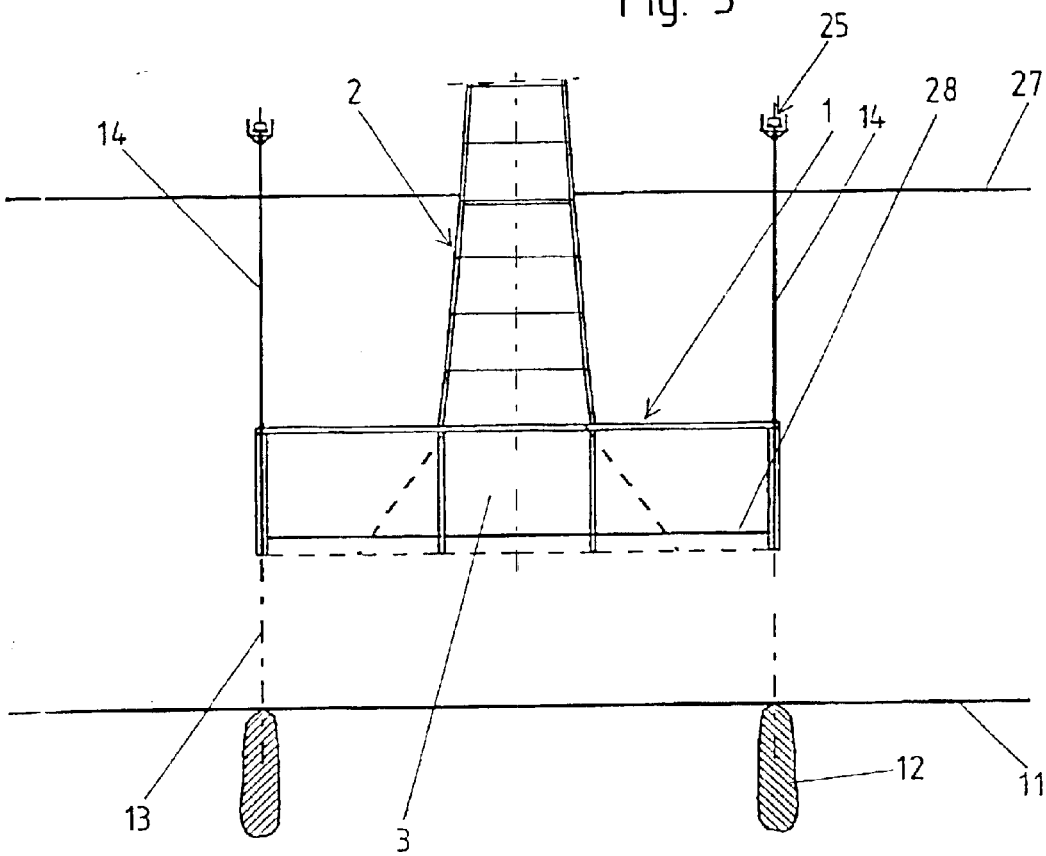
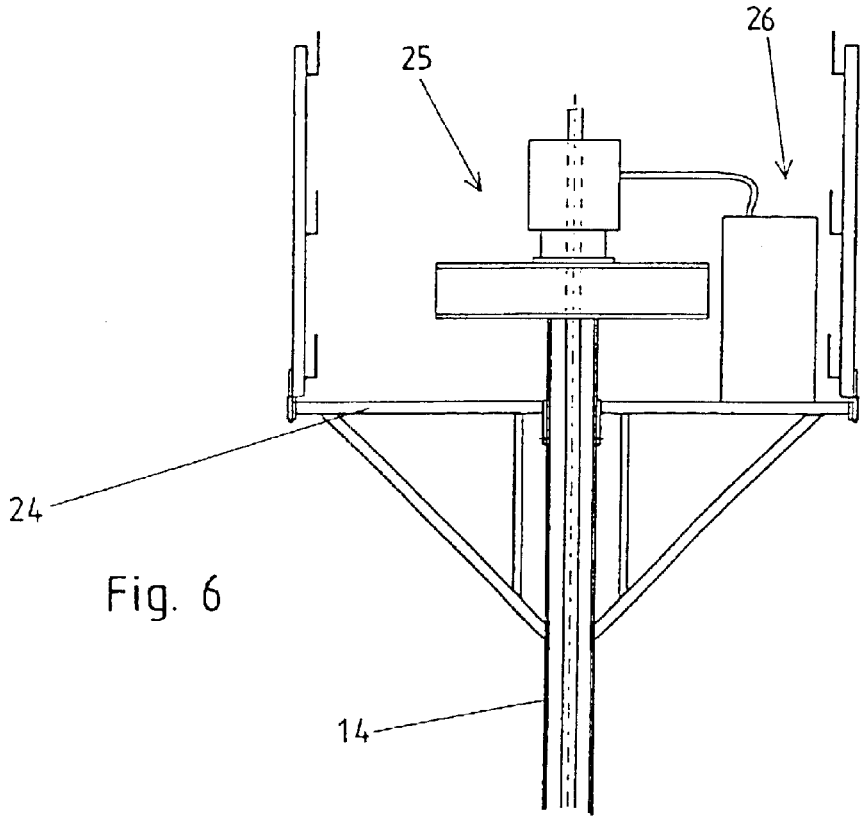
Fig. 6

METHOD OF LOWERING A FLOATING BODY OF A FLOATING FOUNDATION

BACKGROUND OF THE INVENTION

1. Field of the Invention

The present invention relates to a method of lowering a floating body of a floating foundation and carrying a structure projecting above the water surface to an end position located beneath a water level and of securing the floating body in the end position with cables or rods connected with anchors set in the ground.

2. Description of the Prior Art

Floating foundation, e.g., which are used in oil rigs, are known. Such floating foundations include a floating body that supports the weight of a structure projecting above the water surface. The structure has a portion located beneath the water surface and a portion located above the water surface and which, in case of an oil rig, includes a derrick. The sum of the buoyancy of the floating body of the floating foundation and of the buoyancy of the underwater portion of the structure correspond exactly to the weight of the entire construction, i.e., the entire construction floats in water, with the floating body of the floating foundation being located beneath the water surface. In order for the construction to retain its position above the seabed, the floating foundation is retained against a horizontal displacement relative to the seabed by cables, rods, or hawsers connected with the set in the seabed, anchors. The cables, ropes or hawsers extend at an angle to a horizontal of, e.g., 45°.

The cable, rope, hawser retaining anchors are formed dependent on the ground, e.g., as rock anchors for rock beds, as stay-bars for gravel beds . . . Conventionally, the cable-forming strings remain open (hanging loose). The end of a cable is inserted in a bore formed in the ground, and a mortar is pressed through an injection tube that extend up to the front end of the cable, providing for anchoring the cable. Other anchoring methods, e.g., using a pure mechanical clamps and the like, are also known.

A floating foundation with a floating body located beneath a water surface and retained by cables or hawsers connected with the set in the ground, anchors is disclosed in U.S. Pat. No. 5,964,550. Japanese Publication JP 06255573 discloses a construction the base of which lies beneath the water surface, with the structure projecting above the water surface, and which is held by cables or hawsers in its position, with the cables or hawsers being connected with set in the ground, anchors.

European Application EP 02 015395.3 discloses a floating foundation for a projecting above the water surface, structure which is retained in its end position beneath the water surface against a buoyancy force of at least one buoyancy body by locking devices anchored in the ground. The buoyancy force is greater than it would be necessary for retaining the floating condition of the entire construction in the end position of the floating body, i.e., the floating body, because of the amount of its buoyancy, is preloaded with respect to the locking devices. This increases the stability of the floating foundation. The displacement of the floating foundation, together with the supported structure to a predetermined site, is effected by floating it over the water surface. However, the lowering of the floating foundation to its end position is associated with a considerable underwater work, which is associated with increased costs.

An object of the present invention is to provide a method of lowering a floating foundation, which floats above the water surface, to its end position, beneath the water surface against the buoyancy of the floating body, with the underwater work being substantially reduced.

SUMMARY OF THE INVENTION

This and other objects of the present invention, which will become apparent hereinafter, are achieved by providing a method of lowering a floating body of a floating foundation and carrying a structure projecting above a water surface to an end position located beneath the water level, and of securing the floating body in the end position. The method includes forming, in the floating body which floats above the water surface, at least three through-openings in corner points of an imaginary triangle, securing, to the floating body above each of the through-openings, an upwardly projecting tube, and threading, through each of the upwardly projecting tubes, a cable or a rod and connecting the cable or the rod with a set-in-ground anchor.

There is provided, in a region of an upper end of each of the upwardly projecting tube, an uptake device connectable with the respective cable or rod. Then, the floating body, is lowered with the uptake devices, to its end position beneath the water surface against buoyancy of-the floating body, and the cables or rods, in its end position of the floating body, are fixedly secured thereto. Thereafter, sections of the cables or rods above fixation points of the cables or rods with the floating body are cut off, and the upwardly projecting tubes, which are located above the respective through-openings, are removed.

The novel features of the present invention, which are considered as characteristic for the invention, are set forth in the appended claims. The invention itself, however both as its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 3. a schematic view showing a third phase of lowering and securing a floating foundation in accordance with the method according to the present invention;

FIG. 6. a detail "A" of FIG. 2 at an increased scale;

DETAILED DESCRIPTION OF THE PREFERRED EMBODIMENTS

Figure 1:
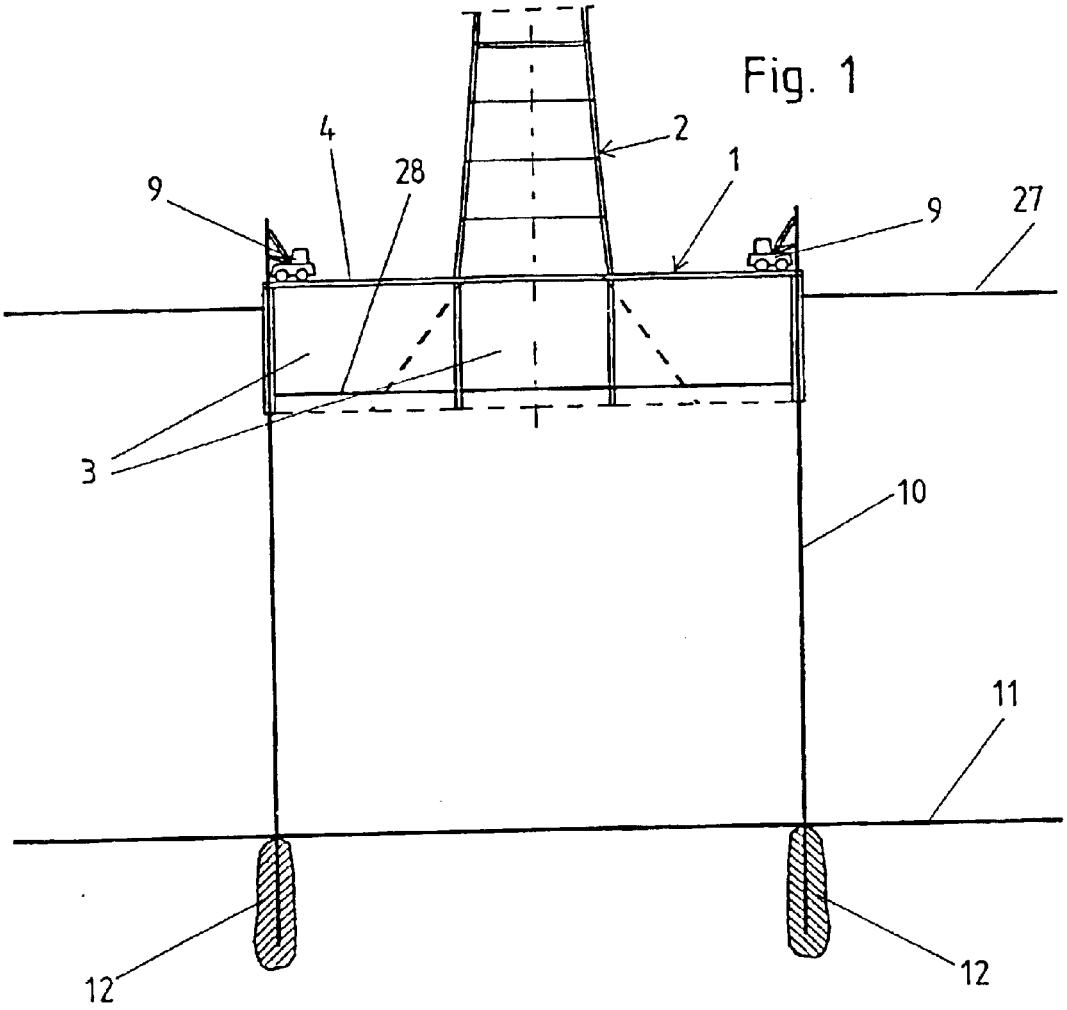
FIG. 1. a schematic view showing a first phase of lowering and securing a floating foundation in accordance with the method according to the present invention.
Figure 5:
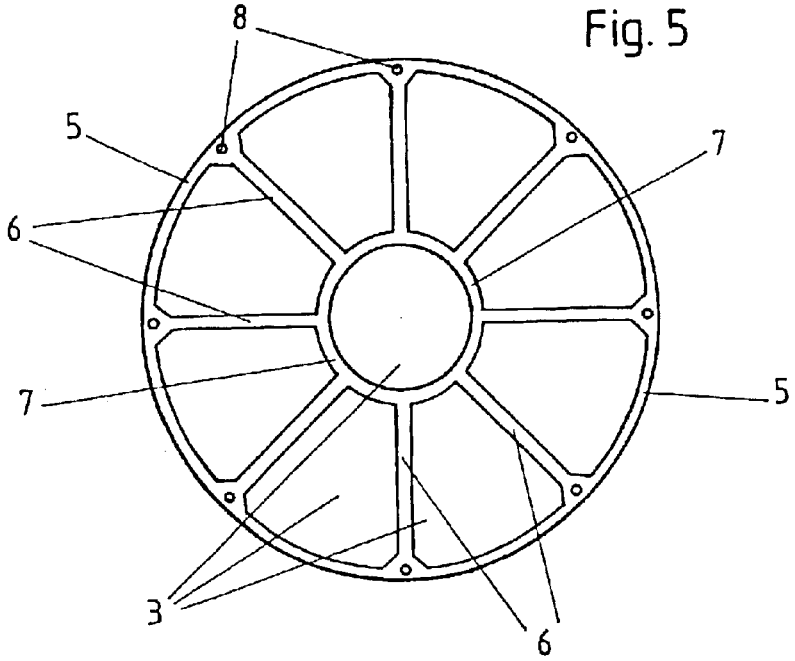
FIG. 5. a schematic bottom view of the floating foundation.

In order to bring a floating body 1 of a floating foundation with a structure 2 erected thereon to its operational site, the floating body 1 floats on a water surface, as shown in FIG. 1. The floating body 1 has a plurality of buoyancy chambers 3 which are open, in the embodiment shown in the drawings, downwardly. The use of closed buoyancy chambers is also possible. In the shown embodiment, the floating body 1 has a deck plate 4 having a circular shape and along the outer edge of which an annular side wall 5 extends. Separate buoyancy chambers 3 are separated from each other by radially extending intermediate walls 6 and inner, annularly extending, intermediate walls 7. Other shapes of the deck plate and/or of the buoyancy chambers are also possible. The floating body shown is the drawings, is shown only symbolically and the shown wall thicknesses are not to the scale.

The structure 2, which is supported on the floating foundation, can represent, e.g., a wind tower of a wind energy plant and of which only the lower portion is shown in the drawings.

A plurality of through-openings 8, which pass through the side wall 5, are provided along the circumference of the floating body 1. A plurality of drilling tools 9, which are arranged on the floating body 1, are used for drilling bores, with the drills 10 that extend through the respective through-openings 8, in the ground 11, in particular in the seabed. Subsequently, anchors 12, e.g., conventional rock anchors or tie rods will be secured in these bores.

Figure 2:
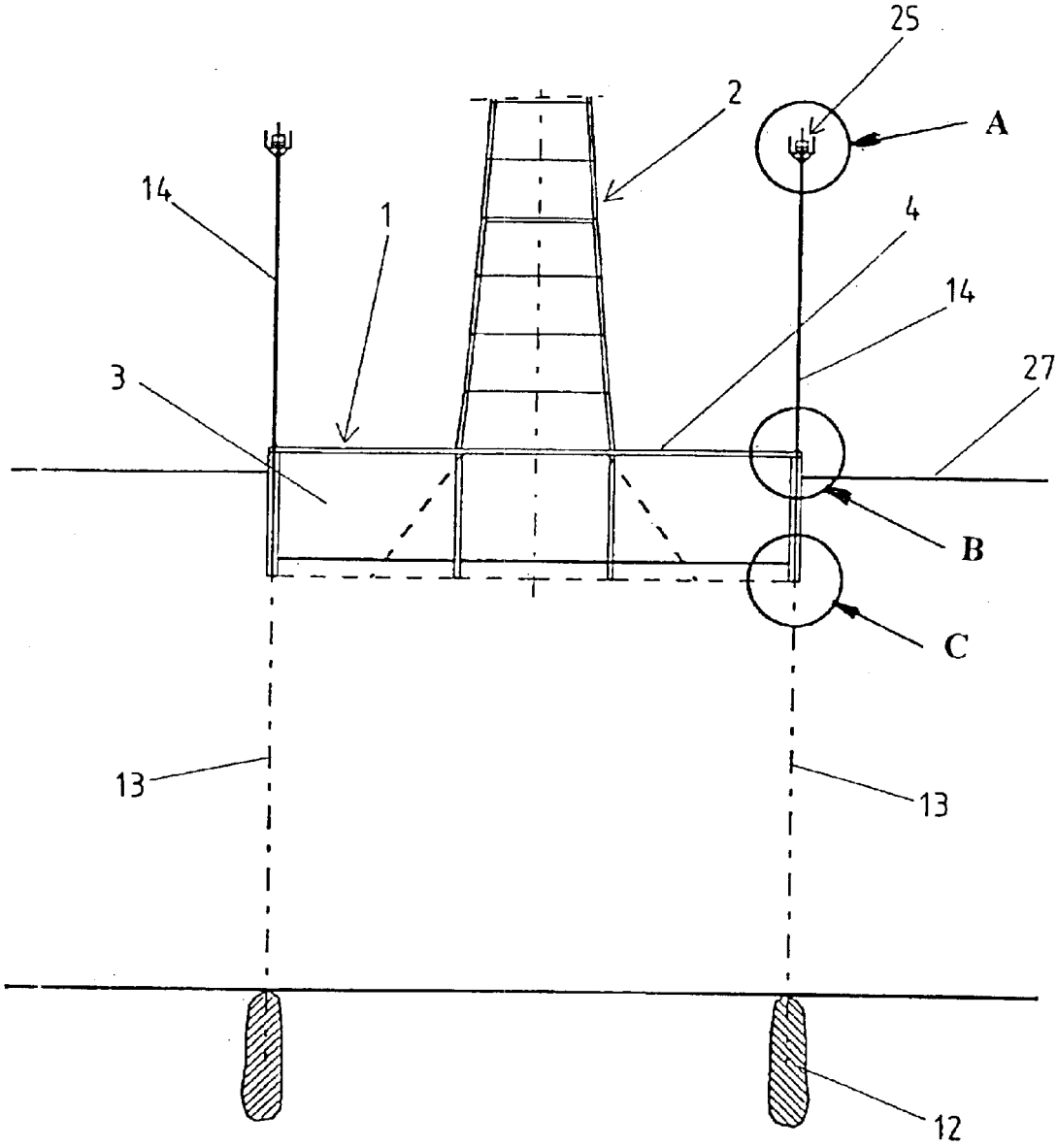
FIG. 2. a schematic view showing a second phase of lowering and securing a floating foundation in accordance with the method according to the present invention.
Figure 4:
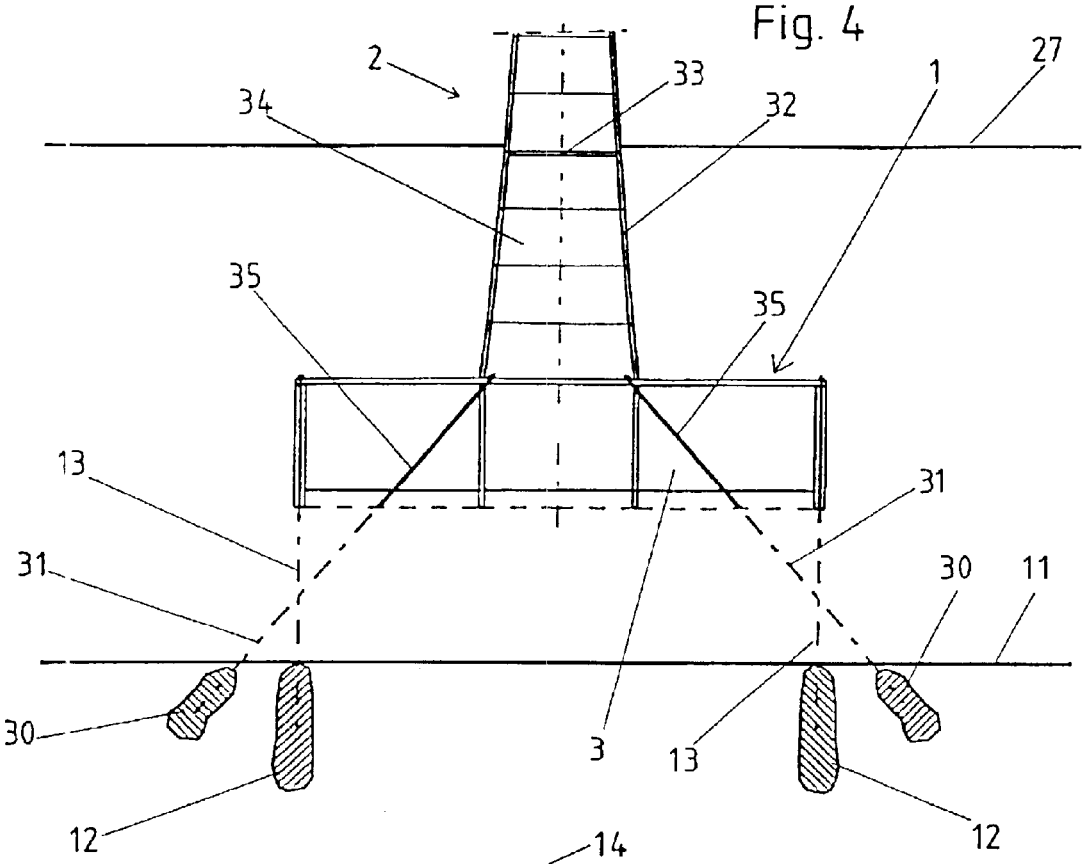
FIG. 4. a schematic view showing a fourth phase of lowering and securing a floating foundation in accordance with the method according to the present invention.

A flexible cable 13 (e.g., a hawser) or a more of less rigid rod, which is shown in FIGS. 2–4 with dash lines, can be secured to each of the anchors 12. The cable 13 can be, if needed, surrounded with a flexible sheath.

Instead of using the drilling tools (9) mounted on the floating body 1 for forming the bores for the anchors 12, the anchors can be secured in the seabed independently of the floating body 1, e.g., before the floating body 1 is brought to its site of use.

Generally, above each through-opening 8, an upwardly extending tube 14 is secured on the floating body 1. This can be effected, e.g., in a manner schematically shown in FIG. 7. Above each through-opening 8 (which can be limited by a tube 15), mounting brackets 16 are secured on the deck plate 4. The mounting brackets 16 have each a flange plate 18 which is screwed to the deck plate 4 with screws 17, providing for securing the mounting bracket 16 to the deck plate 4. An upwardly extending riser 19 is welded to the flange plate 18. A flange disc 20 is secured to the upper end of the riser 19. The tube 14, together with a base plate 21 secured to its lower end, is secured to the flange disc 20, with a screw bolt 22 that extends through the base plate 21 and the flange disc 20. Between the risers 19, mounting openings 23 are provided.

In the region of the upper ends of the base body 1, a production platform 24 is secured on respective tubes 14 (FIG. 6). The cables (hawsers or ropes) 13 or rods, which are connected to the anchors 12, extend through the tubes 14 up to above the upper ends of the tubes 14. E.g., the cables 13 or the rods can be threaded into the tubes before the tubes 14 are secured on the floating body 1. On the upper end of the tube 14, there is arranged an uptake apparatus 25 that can be operated, among others, by a hydraulic device 26. Such uptake apparatuses are known as "tendon presses" or "lifting hydraulic apparatuses" and are commercially available. With these uptake apparatuses 25, cable 13 or rods can be pulled out of the tubes 14. In effect, with a simultaneous pull of the cables 13, the floating body 1 is pulled downwardly by beneath the water surface 27 and against the buoyancy of the floating body 1 until the floating body 1 reaches its end position shown in FIG. 3.

To facilitate pulling of the floating body 1 downwardly, the buoyancy of the floating body 1 can be changed during this process, by reducing the air volume in the buoyancy chambers 3. However, lowing is always effected against the buoyancy of the floating body 1 which exceeds the weight of the structure 2 carried by the floating body 1 (subsequently, the lowering takes place in connection with a portion of the structure located beneath the water surface). The water level in the buoyancy chambers is shown in the drawings with a line 28. Because lowering of the floating body 1 is effected against its buoyancy, a certain stabilization of the floating body 1 during the lowering is achieved.

In the position shown in FIG. 3, the end position of the floating body 1, the upper ends of the tubes 14 always project above the water surface 27, so that lowering of the floating body 1 from the production platform 24 above the water surface 27 can be effected.

Figure 7:
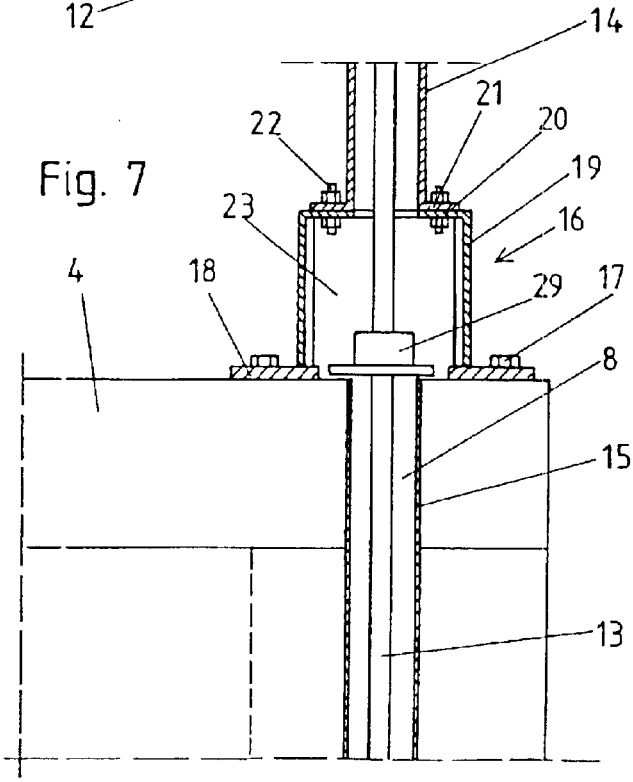
FIG. 7. a detail "B" of FIG. 2 at an increased scale.

Subsequently, the cables 13 or the rods are fixed with respect to the floating body 1, with clamping devices 29 which are shown schematically in FIG. 7 and can be closed through the mounting openings 23 in the mounting brackets 16 for clamping the cables 13. The cables 13 or the rods are cut off only above the clamping devices 29, and the tubes 14 are removed from the mounting brackets. In order to water-tight seal the ends of the cables 13, subsequently, the mounting openings 23 and the through-openings in the flange discs 20 of the mounting brackets 16 can be closed, and the mounting brackets 16 are filled with foam. These works are done by divers.

In order to further increase the stability of the floating foundation, in addition to substantially vertically extending rods or cables 13 (which extend to a vertical at angle of less than 10°), further rods or cables should be provided which would extend to or be inclined to the vertical at an angle between 25 and 45°. In order to secure anchors 30 for the inclined rods or cables 31 (hawsers), in the lower region of the structure 2, a water-free region, of a caisson type, is formed. To this end, the circumferential wall 32 of the structure 2 is circumferentially closed and water-sealed at least in its lower region, and further, a water and/or air-tight intermediate deck 33 is provided. Into this space 34, through-bores, which pass through the floating body 1 and are inclined to a vertical, open. These through-bores can be formed, e.g., by tubes 35 extending through the floating body 1 and inserted, advantageously, in the intermediate walls 6 of the floating body 1. Upon lowering of the floating body beneath the water surface, these tubes can be sealed to prevent penetration of water when the space 34 is not yet completely sealed or the production apparatuses are lowered through an opening in the intermediate deck 33. In the lowered position, the tubes 35 are open, and the air-tight space 34 remains free of water due to the available air pressure.

On the deck plate 4, within the space 34, one or more drilling tools can be located for forming bores in the ground 11 with corresponding drills extending through the tubes 35 for setting the anchors 30. Cables 31 or appropriate rods are connected with the anchors 30. The cables 31 or rods extend through the tubes 35 and are secured to the floating body 1. Thus, the works for setting the anchors 30 and for securing the cables 31 or rods need not to be effected by divers, and the works done by divers, can be reduced to a minimum.

Figure 8:
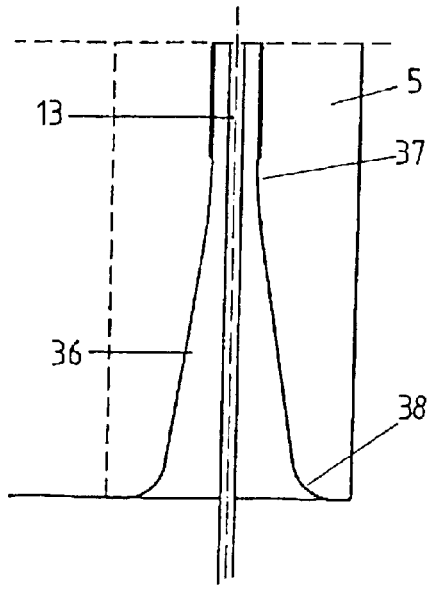
FIG. 8. a detail "C" of FIG. 2 at an increased scale.

FIG. 8 shows an advantageous formation of a through-opening 8 in the region of its lower end section. In order to be able to move the floating body 1 with the cables 13, the lower end sections of the through-openings expand conically outwardly, with the conically expanding regions 36 adjoining portions of the respective openings 8, which lie above the regions 36 by respective radii 37. In its mouth region, the conically expanding region 36 has a further radius 38.

In order to increase the buoyancy of the floating body 1 and thereby, the preload of the rods or cables 13, 31, air is pumped into the buoyancy chambers 3 in the lower end position of the floating body. Preferably, the buoyancy of the floating body in the end position is by 10% greater, advantageously by 20% greater, than the buoyancy required for maintaining the floating condition of the floating body 1 with the, supported thereon, structure 2 that projects above the water surface. In this way, a very stable floating foundation is formed.

In other embodiments, the number and position of the through-openings 8 can be different. Anyway, at least three through-openings 8, which are formed in the corner point of an imaginary triangle, are provided. This imaginary triangle preferably crosses the central region of the floating body 1. Also, besides the openings associated with the tubes 14, four or six more through-openings can be provided for cables 13 and/or rods. The number of the through-opening 8 depends on the size of a floating body. Also, a different number of the inclined, to a vertical, cables 31, which are connected with anchors 30 and extend through the tubes 35, can be provided. Preferably, at least three such cables 31 or rods are provided which extend along side edges of an imaginary pyramid. Also, six, eight or more of such, inclined to a vertical, cables or rods can be provided.

Figure 9:
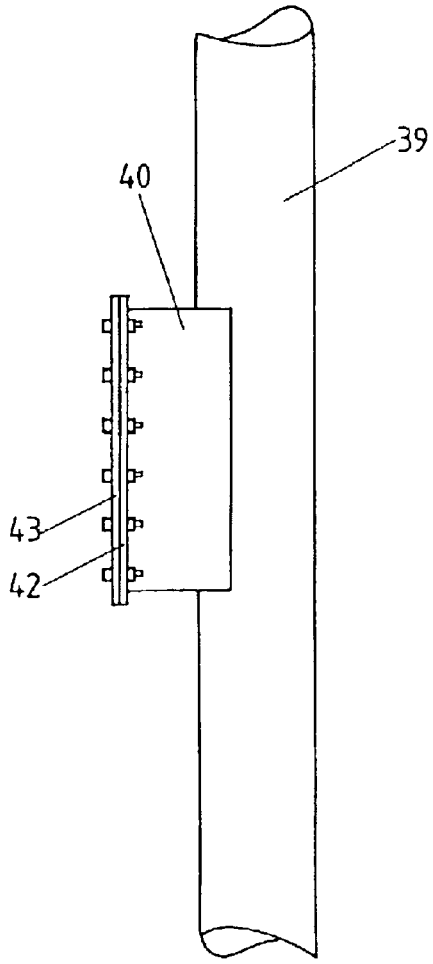
FIG. 9. a side view of a tube for forming a through-opening to a buoyancy chamber and having a closable connection opening.
Figure 10:
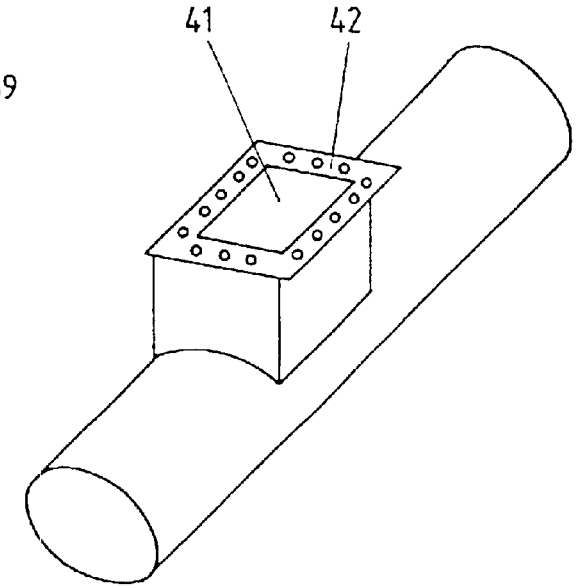
FIG. 10. a perspective view of a tube for forming a through-opening to a buoyancy chamber and having a closable connection opening.

A modified embodiment of the invention will be described based on FIGS. 9–11. FIGS. 9 and 10 show a portion of a tube 39 for forming a through-opening 8 and which is sealingly secured in the floating body 1. In the tube 39, a connection shaft 40 is formed which forms a connection opening 41 between the opening 8 and a respective buoyancy chamber 3. At the free end of the connection shaft 40, a connection flange 42 is provided in which there are formed a plurality of openings so that the shaft 40 can be closed with a locking plate 43.

For servicing the cables 13, hawsers or rods, in the end position of the floating body beneath the water surface, the through-openings 8 are sealed above the connection openings 41, (e.g., with a plastic foam). Subsequently, the water level in the respective buoyancy chambers 3, from which the following works should be done, if needed, is lowered so far that it lies beneath the connection opening(s) 41. The water level in the adjacent buoyancy chambers 3 can correspondingly be elevated. The connection opening 41 is open by removing the locking plate 43, so that the cable 13, which extends through a respective through-opening 8, becomes accessible from a respective buoyancy chamber 3.

Figure 11:
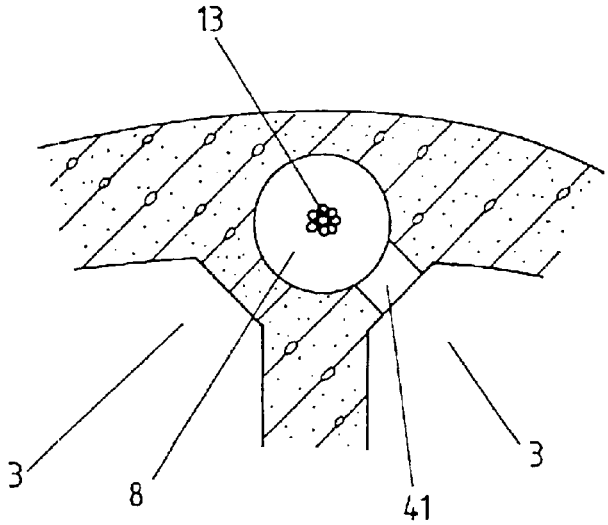
FIG. 11. a schematic cross-sectional view of a portion of the floating body in the region of the connection opening of the through-opening.

A clamping device, not shown in FIGS. 9-11, which has already been described above, can be used for clamping the cable 13 or the rod which is cut off above the clamping device. This region can be water-sealed, e.g., by a plastic foam.

The clamping can be effected under dry conditions, so that no salt water would penetrate in the cut-off, tensioned cable. This facilitates the works and reduces the danger of the corrosion.

The through-openings 8 can also be sealed beneath the connection openings 41. After the works are finished, the connection openings 41 can again be closed with locking plates 43.

In the same manner, it is also possible to effect clamping of the inclined cables 31 or rods through connection openings in the tubes 35 from the buoyancy chamber 3.

Other modification are also possible. E.g., the floating body 1 can be formed of several, connected with each other sections.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A method of lowering a floating body of a floating foundation and carrying a structure projecting above a water surface to an end position located beneath the water level, and of securing the floating body in the end position, the method comprising the steps of:

forming in the floating body, which floats above the water surface, at least three through-openings in corner points of an imaginary triangle;

securing, to the floating body above each of the through-openings, an upwardly projecting tube;

threading through each of the upwardly projecting tubes, one of cable and rod and connecting the one of cable and rod to a set-in-ground anchor;

providing, in a region of an upper end of each of the upwardly projecting tubes, an uptake device connectable with a respective one of cable and rod;

lowering the floating body, with the uptake devices, to the end position thereof beneath the water surface against buoyancy of the floating body; and fixedly securing the ones of cables and rods, in the end position of the floating body, to the floating body and cutting off sections of the ones of cables and rods above fixation points of the ones of cables and rods with the floating body and removing the tubes which upwardly project above the respective through-openings.

2. A method as set forth in claim 1, wherein the step of securing the upwardly projecting tubes includes providing tubes each having a length larger than a distance the floating body is spaced from the water surface in the end position thereof.

3. A method as set forth in claim 1, wherein the step of securing the upwardly projecting tubes comprises securing each upwardly projecting tube to a mounting bracket secured on the floating body and having a mounting opening through which in the end position of the floating body, a clamping device for securing the ones of cable and rod is operated.

4. A method as set forth in claim 1, wherein the through-openings forming step comprises forming, along a circumference of the floating body, at least four through-openings, and wherein the upwardly projecting tube securing step comprises securing the upwardly projecting tube above each of the at least four through-openings.

5. A method as set forth in claim 1, wherein the through-openings forming step comprises forming, along a circumference of the floating body, at least six through-openings, and wherein the upwardly projecting tube securing step comprises securing the upwardly projecting tube above each of the at least six through-openings.

6. A method as set forth in claim 1, comprising the step of providing, on a deck plate of the floating body, drilling tools for forming, in the ground, with drills extendable through respective through-openings, bores in which connectable with the ones of cables and rods, anchors are set.

7. A method is set forth in claim 1, wherein the upwardly projecting tubes extend substantially vertically, and wherein in addition to the ones of cables and rods, which extend substantially vertically by virtue of extending through the substantially vertically extending, upwardly projecting tubes, further ones of cables and rods inclined to the vertical are provided.

8. A method as set forth in claim 7, wherein the further ones of cable and rods are inclined to the vertical at an angle in a range between 25° and 40°.

9. A method as set forth in claim 7, comprising the steps of forming, in a lower region of the structure carried by the floating body, a caisson for forming, in the ground, bores for anchors for the further ones of cable and rods, and providing in the caisson, drilling tools for drilling the bores with drills extendable through the through-openings in the floating body.

10. A method as set forth in claim 9, further comprising the step of fixedly securing the further ones of cables and rods to the floating body in the caisson.

11. A method is set forth in claim 9, further comprising the steps of providing, between a respective through-opening and one of buoyancy chambers of the floating body, a closable opening for effecting securing of a respective one of cable and rod and a respective one of further cable and rod to the floating body.

12. A method asset forth in claim 11, comprising the steps of sealing the respective through-opening at least one of above the closable opening and below the closable opening, and lowering a water level in the respective through-openings, during a fixation process, below a clamping device.

13. A method as set forth in claim 11, further comprising the step of lowering a water level in the one of buoyancy chambers during a fixation process.

14. A method as set forth in claim 1 comprising the step of increasing the water level at least in one of adjacent, to the one of buoyancy chambers, chambers by an amount corresponding to an amount by which the water level in the one of the buoyancy chambers was lowered.

15. A method as set forth in claim 1, comprising the step of reducing, during lowering of the floating body, the buoyancy of the floating body in comparison with that the floating body has in the end position thereof.

16. A method as set forth in claim 1, wherein the through-openings forming step comprises forming the through-openings with tubs molded into the floating body.

* * * * *